US008869460B2

(12) United States Patent
Krishnan et al.

(10) Patent No.: US 8,869,460 B2
(45) Date of Patent: Oct. 28, 2014

(54) DEPLOYABLE STRUCTURAL UNITS AND SYSTEMS

(71) Applicant: California Institute of Technology, Pasadena, CA (US)

(72) Inventors: Swaminathan Krishnan, Pasadena, CA (US); Sergio Pellegrino, Pasadena, CA (US); Thomas H. Heaton, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 13/734,543

(22) Filed: Jan. 4, 2013

(65) Prior Publication Data

US 2013/0174495 A1 Jul. 11, 2013

Related U.S. Application Data

(60) Provisional application No. 61/583,548, filed on Jan. 5, 2012.

(51) Int. Cl.
*E04H 9/00* (2006.01)
*E04B 1/00* (2006.01)
*E04B 1/98* (2006.01)

(52) U.S. Cl.
CPC ..... *E04B 1/98* (2013.01)
USPC ..... 52/1; 52/127.2

(58) Field of Classification Search
USPC ..... 52/1, 127.2, 698, 149
See application file for complete search history.

(56) References Cited

U.S. PATENT DOCUMENTS

| | | | | | |
|---|---|---|---|---|---|
| 4,920,710 | A * | 5/1990 | Paine | 52/108 |
| 5,299,654 | A | 4/1994 | Duncan | |
| 5,491,938 | A * | 2/1996 | Niwa et al. | 52/167.1 |
| 5,819,484 | A * | 10/1998 | Kar | 52/167.3 |
| 5,934,028 | A * | 8/1999 | Taylor | 52/167.3 |
| 5,979,126 | A * | 11/1999 | Kurino et al. | 52/167.2 |
| 6,385,916 | B1 * | 5/2002 | Marko | 52/127.2 |
| 6,408,592 | B1 * | 6/2002 | Hourani | 52/741.3 |
| 6,672,573 | B2 * | 1/2004 | Berton | 267/136 |
| 6,854,222 | B2 * | 2/2005 | Hansort | 52/127.2 |

(Continued)

FOREIGN PATENT DOCUMENTS

| | | | | |
|---|---|---|---|---|
| JP | 08246702 A * | 9/1996 | | E04H 9/02 |
| JP | 2000/0179182 | 6/2000 | | |

(Continued)

OTHER PUBLICATIONS

Machine translation of JP 2000-179182 A, pulled Dec. 8, 2013, p. 1-12.*

(Continued)

*Primary Examiner* — Elizabeth A Plummer
(74) *Attorney, Agent, or Firm* — Steinfl & Bruno LLP

(57) ABSTRACT

Deployable units and systems made of deployable units are described. The units have a retractable brace transitioning from a retracted condition to a deployed condition through a gravity driven movement, a latching arrangement contacting the brace and keeping the brace in position when the brace is in the deployed condition, and a guiding arrangement to guide the movement of the brace. The systems comprise plural deployable units to be arranged in a building structure, each unit to be located in a respective bay per story space of the building structure.

20 Claims, 6 Drawing Sheets

(56) References Cited

U.S. PATENT DOCUMENTS

| | | | | |
|---|---|---|---|---|
| 7,096,125 | B2 * | 8/2006 | Padmanabhan et al. | 702/24 |
| 2006/0207215 | A1 | 9/2006 | Bruno et al. | |
| 2008/0141598 | A1 * | 6/2008 | Cook | 52/127.2 |
| 2013/0042537 | A1 * | 2/2013 | Orava | 52/1 |

FOREIGN PATENT DOCUMENTS

| | | |
|---|---|---|
| JP | 2004/238826 | 8/2004 |
| JP | 2007/002639 | 1/2007 |
| JP | 2012229581 A * | 11/2012 |

OTHER PUBLICATIONS

Machine translation of JP 2007-002639, pulled Dec. 8, 2013, p. 1-7.*
1-International Search Report for PCT Application PCT/US2013/020291 filed on Jan. 4,2013. Mail date: Apr. 26, 2013.
2-Written Opinion of the International Searching Authority for PCT Application PCT/US2013/020291 filed on Jan. 4, 2013. Mail date: Apr. 26, 2013.
3-Black, C., et al. "Component testing, stability analysis, and characterization of buckling-restrained unobonded braces." Tech. Rep. PEER 2002/08, Pacific Earthquake Engineering Research Center, College of Engineering, U.C. Berkeley, California, USA, Sep. 2002, pp. 1-100.
4-Constantinou, MC, et al. "Experimental and analytical investigation of seismic response of structures with supplemental fluid viscous dampers." Tech. Rep. NCEER 1992/0032, National Center for Earthquake Engineering Research, State University of New York at Buffalo, Buffalo, New York, USA, Sep. 21, 1992, pp-1-1-c-12.
5-Cua, G., et al. "7 The Virtual Seismologist (VS) method: A Bayesian approach to earthquake early warning." In Earthquake Early Warning Systems (2007), P. Gasparini, G. Manfredi, and J. Zschau, Eds., Springer, pp. 97-132.
6-Dyke, S J. et al. "An experimental study of MR dampers for seismic protection." Smart Materials and Structures, 7 (1998), pp. 693-703.
7-Escrig, F. "General survey of deployability in architecture." In Mobile and Rapidly Assembled Structures (1996), Computational Mechanics Publications, pp. 3-22.
8-Gavin, HP et al. "Electrorheological dampers Part II: Testing and modeling." Journal of Applied Mechanics 63 (Sep. 1996), pp. 676-682.
9-Krishnan, S., et al. "Performance of two 18-story steel moment frame buildings in southern California during two large simulated San Andreas earthquakes." Earthquake Spectra 22,4 (Nov. 2006), pp. 1035-1061.
10-Muto, M., et al. "Hope for the best, prepare for the worst: Response of tall steel buildings to the shakeout scenario earthquake." Earthquake Spectra 27,2 (May 2011), pp. 375-398.
11-Nagarajaiah, S., et al. "Adaptive negative stiffness: A new structural modification approach for seismic protection." In Proceedings of the 5th World Conference on Structural Control and Monitoring, Tokyo, Japan (2010). Paper No. 5WCSCM-103.
12-Pellegrino, S. "Large retractable appendages in spacecraft." Journal of Spacecraft and Rockets 32, 6 (Nov.-Dec. 1995), pp. 1006-1014.
13-Ryan, K. L., et al. "Introduction to NEES TIPS: Tools for isolation and protective systems." In Proceedings of the 18th Analysis and Computation Specialty Conference (2008).
14-Weldon, RJ., et al. "Past and Future Earthquakes on the San Andreas Fault." Science 308 (May 13, 2005), pp. 966-967.
1-Gilmartin, S.K., et al.(2006) The relationship between interest physical science/engineering science class experiences, and family context: variations by gender and race/ethnicity among secondary students. Journal of Women and Minorities in Science and Engineering, 12, pp. 179-207.
Krishnan, s. (2010) The modified elastofiber element for steel slender column and brace modeling. Journal of Structural Engineering, 136, pp. 1350-1366.
Krishnan, S. and Muto, M. (2012) Mechanism of Collapse of Tall Steel Moment Frame Buildings Under Earthquake Excitation. In: 15th World Conference in Earthquake Engineering. International Association for Earthquake Engineering, pp. 1-10.
Krishnan, Swaminathan and Muto, Matthew (2013) Sensitivity of the Earthquake Response of Tall Steel Moment Frame Buildings to Ground Motion Features. Journal of Earthquake Engineering, 17 (5), pp. 673-698. ISSN 1363-2469.
5-California Institute of Technology-Caltech Center for Diversity. *Caltech Center for Diversity*.Mar. 5, 2014. Web. <http://diversitycenter.caltech.edu/>.
6-California Institute of Technology—Virtual Shaker. *Virtual Shaker*. Mar. 5, 2014 Web. <https://virtualshaker.caltech.edu/>.

* cited by examiner

DEPLOYABLE STRUCTURAL UNITS AND SYSTEMS

CROSS REFERENCE TO RELATED APPLICATIONS

The present application claims priority to U.S. Provisional Application 61/583,548 filed on Jan. 5, 2012 and incorporated herein by reference in its entirety.

FIELD

The present disclosure relates to protection systems. More in particular, it relates to deployable structural units and systems, wherein each deployable unit can be part of a deployable system, possibly but not necessarily triggered by an early earthquake warning (EEW) to prevent structural damages to buildings.

BACKGROUND

Research into seismic protection systems has been ongoing for several decades. These systems include passive systems such as base isolation, unbonded braces and viscous fluid dampers, active control systems, and semi-active control systems such as stiffness control devices, electro-rheological and magneto-rheological damping devices, etc. The steady development of digital seismic networks, real-time Global Positioning System networks (GPS), and the digital communications revolution provide an opportunity to develop new methodologies to predict and mitigate the impact of earthquakes even while they are occurring. This is often referred to as seismic alerting or alternatively as earthquake early warning (EEW), which is expected to become operational in the US in a short span of 3-5 years from now.

SUMMARY

According to a first aspect of the present disclosure, a deployable unit configured to assume a retracted condition and a deployed condition is provided, comprising: a retractable brace having a retracted condition and a deployed condition, wherein transition from the retracted condition to the deployed condition occurs through gravity driven movement of the brace; a latching arrangement, the latching arrangement contacting the brace and keeping the brace in position when the brace is in the deployed condition; and a guiding arrangement to guide the gravity driven movement of the brace.

According to a second aspect of the present disclosure, a kit of parts is provided, comprising: a brace configured to assume, in operation, a retracted condition and a deployed condition where the brace is deployed, wherein transition from the retracted condition to the deployed condition occurs through gravity driven movement of the brace; a latching arrangement configured to contact, in operation, the brace and keeping the brace in position when the brace is in the deployed condition; a wire, configured to be connected, in operation, with the brace and hold the brace in place when the brace is in the retracted condition and assist the gravity driven movement of the brace during the transition from the retracted condition to the deployed condition of the brace, the wire having a wrapped condition when the brace is in the retracted condition and an elongated condition when the brace is in the deployed condition; and a control system configured to control, in operation, movement of the brace from the retracted condition to the deployed condition and vice versa.

Further aspects of the present disclosure are provided in the specification, drawings and claims of the present application.

DETAILED DESCRIPTION

Throughout the present disclosure, embodiments and variations are described for the purpose of illustrating uses and implementations of the inventive concept. The illustrative description should be understood as presenting examples of the inventive concept, rather than as limiting the scope of the concept as disclosed herein.

Figure 1:
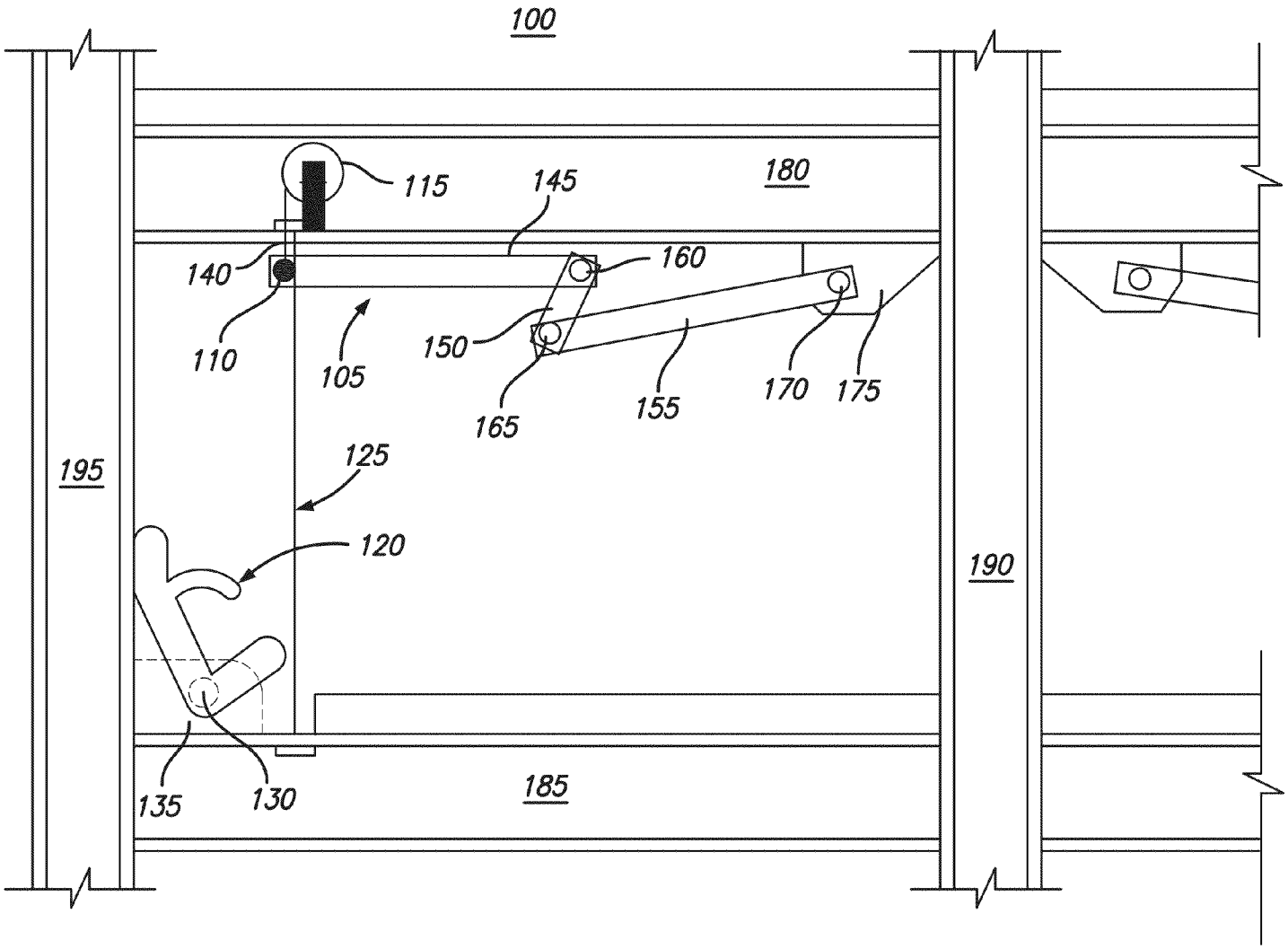
FIG. 1 shows a retracted condition of a deployable unit in accordance with an embodiment of the disclosure.

According to an example embodiment of the present disclosure, FIG. 1 shows a deployable unit (100) comprising a foldable tension-only brace (105) shown in retracted position, an end rod (110) located at a left end of the brace (105), a pulley (115) driven by a hydraulic jack (not shown in the figure), a latching arrangement (120) and a guide rod (125). In the embodiment of the figure, the latching arrangement (120) is hinged (130) to a bottom gusset (135) and comprises two latches, one on either side of the bottom gusset (135). The bottom gusset (135) is further connected to a beam column junction between a lower beam (185) and a left-hand column (195) in one story of a structural bay spanning from one column to the next. FIG. 1 also shows an upper beam (180) between right-hand column (190) and left-hand column (195).

A string (140) (e.g., a rope or a cable made of metal, nylon or fiber) is wound over the pulley (115) and attached to the end rod (110). The guide rod (125) is situated adjacent to the end rod (110) at the left hand side of the brace (105) between beams (180) and (185).

By way of example and not of limitation, the brace (105) can be made of steel bars, cables (made of, e.g., metal or fiber), or a telescopic boom made of one or more tubes/pipes within a tube/pipe, in order to provide a light-weight unit. As later explained in additional detail, the deployable unit (100) can be part of a deployable system triggered by an early earthquake warning (EEW) to prevent structural damages to buildings. Such deployable system can comprise a plurality of individual deployable units (100) like the one shown in FIG. 1, each deployable unit to be placed in a bay (defined as the region spanning from one column of the building to the next) of a story (e.g., within a moment frame) of a building. The deployable unit is thus delimited, when installed, by a quadrangular (e.g., rectangular) grid between two columns and two beams that offers lateral stiffness and strength, as shown in FIG. 1.

With further reference to FIG. 1, the foldable brace (105) is comprised of bars or components (145, 150, 155) connected by hinges (160, 165). A right end hinge (170) connects the brace (105) to a top gusset (175), while the top gusset (175) is connected to a beam column junction between beam (180) and column (190).

Under normal operating conditions (e.g., when no early earthquake warning (EEW) is in effect), the brace (105) is in the retracted or folded condition shown in FIG. 1. In particular, the central bar (150) is rotated through hinges (160, 165) as shown in the figure. This rotated position of the central bar (150) allows the left hand bar (145) to be positioned substantially parallel to the upper beam (180) and the right hand bar (155) at an angle with respect to the upper beam (180). In other words, instead of buckling, the brace will simply fold slightly during its retracted condition. Such retracted condition is maintained stable by keeping the metal string (140) wound over the pulley (115) through fluidic pressure exercised by the hydraulic jack, thus keeping the end rod (110) at a set distance from the pulley (115).

Figure 2:
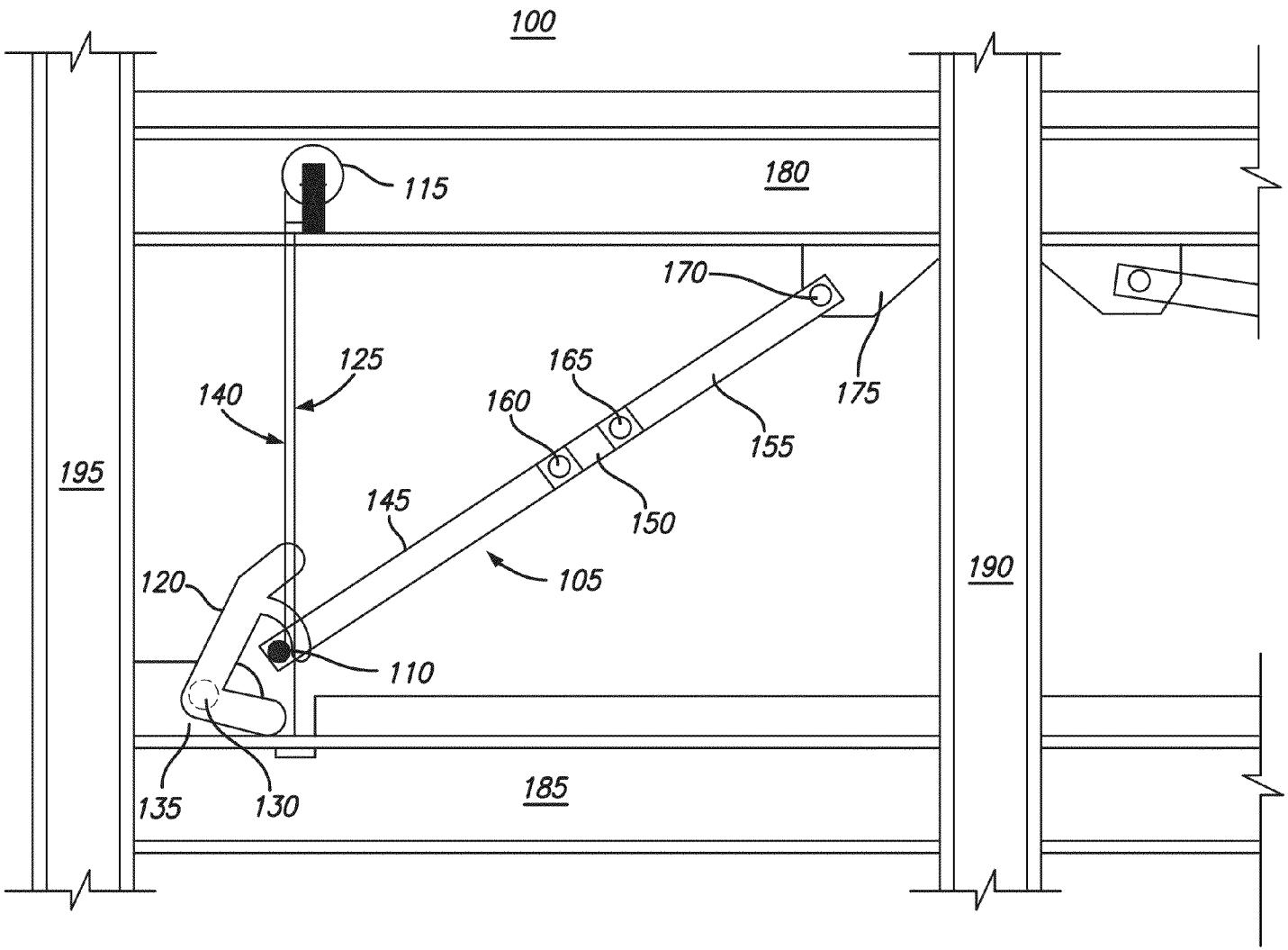
FIG. 2 shows a deployed condition of the deployable unit of FIG. 1.
Figure 6:
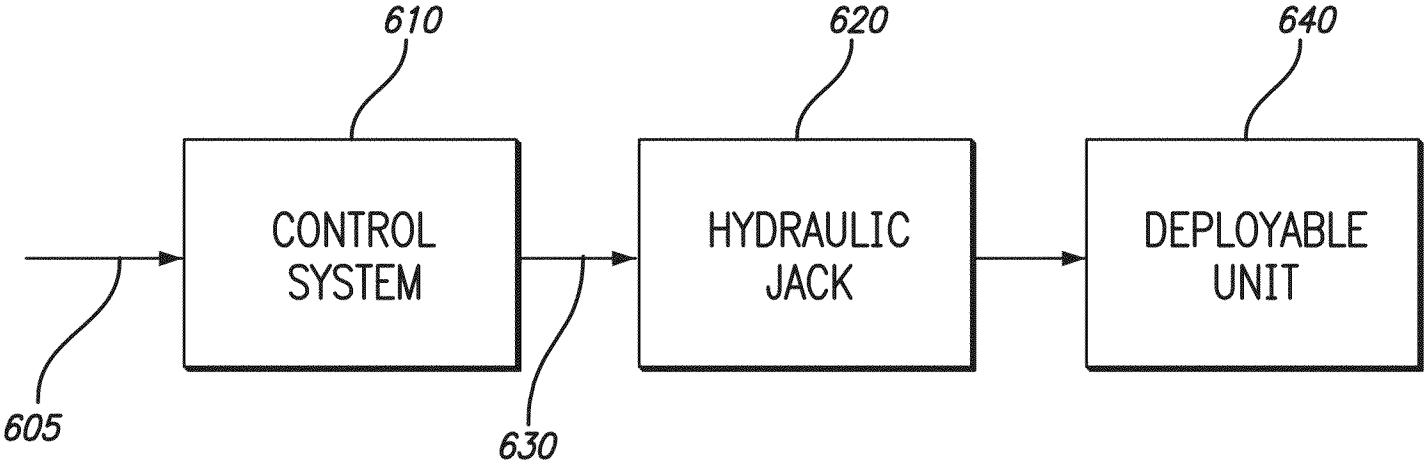
FIG. 6 shows a system diagram of a control system coupled to a deployable unit.

FIG. 2 shows a deployed condition of a deployable unit according to the present disclosure, where the brace (105) is now in a deployed position, e.g. upon triggering of an early earthquake warning. By way of example, when the EEW signal is received by a control circuitry coupled to the deployable unit, the control circuitry (an example of which is shown in FIG. 6, later described) interprets the EEW signal and makes a decision as to whether to output a release command. If the control circuitry originates a release command, power to the hydraulic jack is tripped thus releasing pressure in the hydraulic jack, and the brace (105) drops down through gravity, driven by its own weight, thus reaching the condition shown in FIG. 2. In particular, as soon as the brace (105) drops down, the latching arrangement (120) is tipped, so that both latches hook on to the end rod (110) at the left end of the brace (105).

In other words, release of the pressure of the hydraulic jack frees the metal string (140) around the pulley (115) so that the end rod (110) and consequently the brace (105) drop down. Presence of the guide (125) allows the downward movement of the metal string (140), end rod (110) and brace (105) to be guided in a predictable way, so that both latches of the latching arrangement (120) can hook on to the end rod (110) to secure the brace (105) in its deployed position. Additionally, the central bar (150), initially in a retracted condition, moves towards the left during the fall of the brace (105), thus allowing full deployment of the brace (105) through alignment of the components (140), (145) and (150).

The unit shown in FIG. 2 can be easily returned to the condition of FIG. 1 assuming no structural damage to its components, by disengaging or rotating the latch (120) and retracting the wire (140), thus lifting the brace (105).

Figure 3:
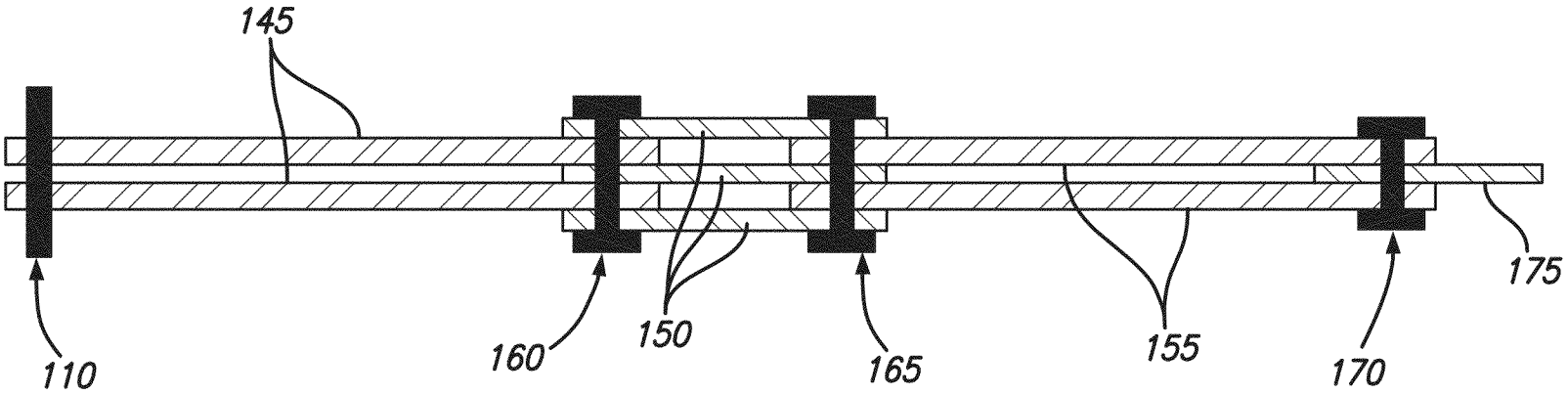
FIG. 3 shows an example of a foldable brace to be used with the embodiment of FIGS. 1 and 2.

FIG. 3 shows a partially sectioned view from the top of an embodiment of the brace (105) when in the deployed condition of FIG. 2. In such embodiment, each component (145, 150, 155) is formed by a plurality of bars. By way of example and not of limitation, in the embodiment of FIG. 3, component (145) comprises two bars, foldable component (150) comprises three bars and component (155) comprises two bars. Also shown in FIG. 3 are rod (110), hinges (160, 165, 170) and gusset (175), wherein the end rod (110) is connected between the two bars of component (145), hinge (160) couples the components (145) and (150), hinge (165) connects the component (150) to the component (155) and hinge (170) couples the gusset (175) to the component (155).

According to several embodiments of the present disclosure, since the brace (105) is foldable, it can act only in tension, and does not engage in compression when deployed. Additionally, if desired, the holes at the interior hinges (160 and 165) can be designed to be oversized in order to allow for easy folding even in the deployed condition when the polarity or phase of shaking is such that it tries to induce compression in the brace (105). Given that during an earthquake there will be a relative, predominantly horizontal, motion between beams (180) and (185), the tension-only nature of the brace will offer ductile resistance to this motion, thus minimizing overall frame distortion and building lateral deformation.

The deployable unit (100) shown in FIGS. 1 and 2 can be installed in a bay of a story of a building, thus delimited by beams and columns. In other words, all of the elements of the unit (such as brace, latching arrangement, wire, guiding rod etc) can be located in such area, possibly hidden from the view of inhabitants of the building by being located inside a falsework structure, thus causing neither impediment nor injury to inhabitants. Independently of the presence of a falsework structure or not, the deployable unit according to the present disclosure can be located either on the inside or on the outside of a building. Additionally, while FIGS. 1 and 2 show a unit with a latching and vertical deployment on the left side, a complementary unit where latching and vertical deployment occur on the right side may also be advantageously provided, the pair of units offering tensile resistance alternately to shaking to-and-fro.

As mentioned previously, the deployable unit (100) can be part of a deployable system triggered by an early earthquake warning (EEW) to prevent structural damages to the high-rise steel moment frame buildings. Such deployable system can comprise a plurality of individual deployable units (100), like those shown in FIGS. 1 and 2 or, advantageously, a plurality of pairs of units, as described above. In such case, each brace in the deployable system can have its own dedicated jack and due to the light weight of the brace, the jacks can be low capacity as well. Additional embodiments can also be provided, where the braces are controlled as a group, rather than individually. Also, in case of systems provided with multiple units (as later described with respect to FIGS. 4 and 5), embodiments can be provided where two horizontally adjacent units have different orientations, so that a first deployable unit has a brace with its top on the right and its bottom on the left in the deployed condition, and a second, horizontally adjacent, deployable unit has a brace with its top on the left and its bottom on the right in the deployed condition.

Figure 4:
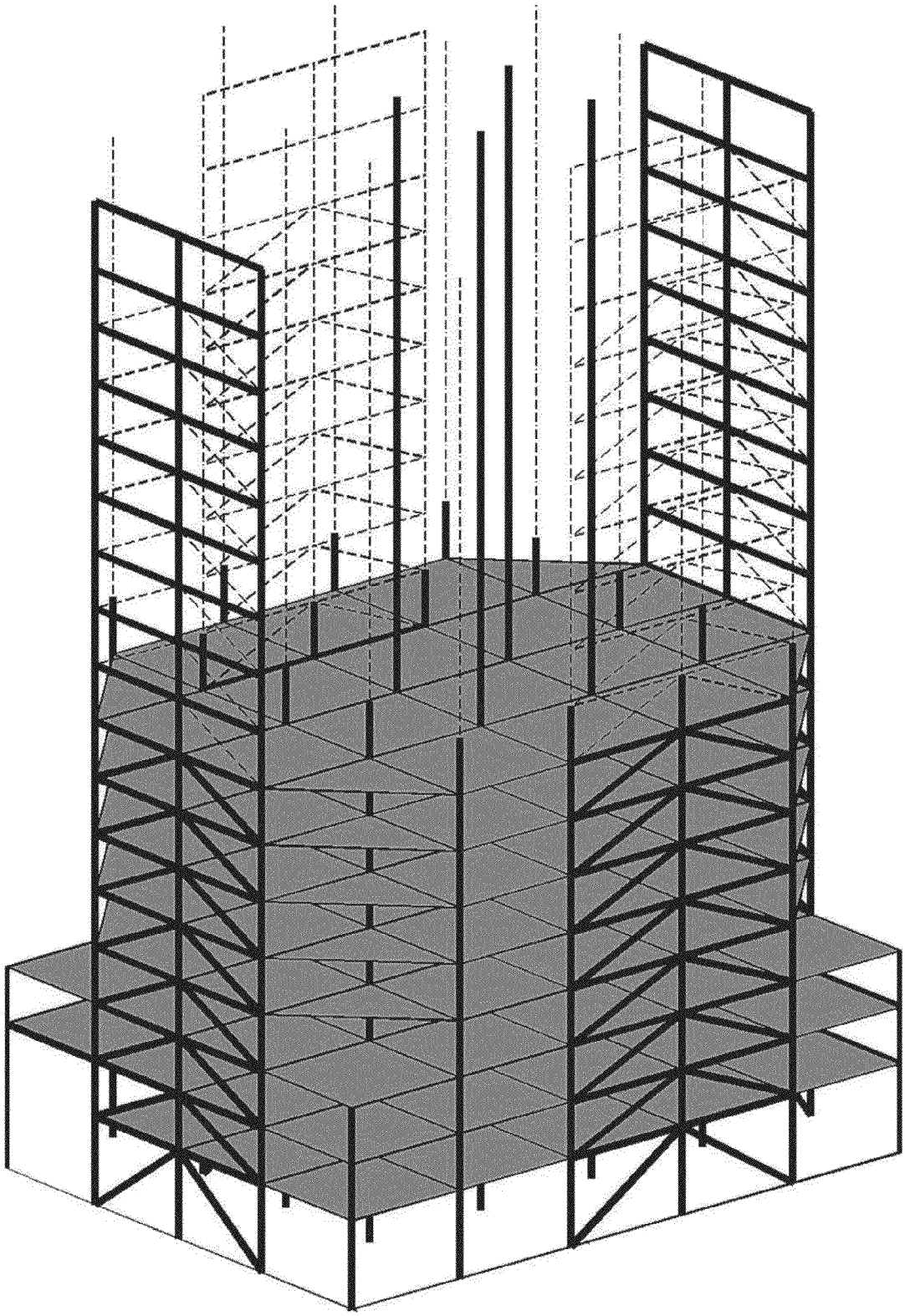
FIGS. 4 and 5 show computer-aided renditions of isometric views of different configurations of a deployable system comprising plural deployable units in a multistoried building.
Figure 5:
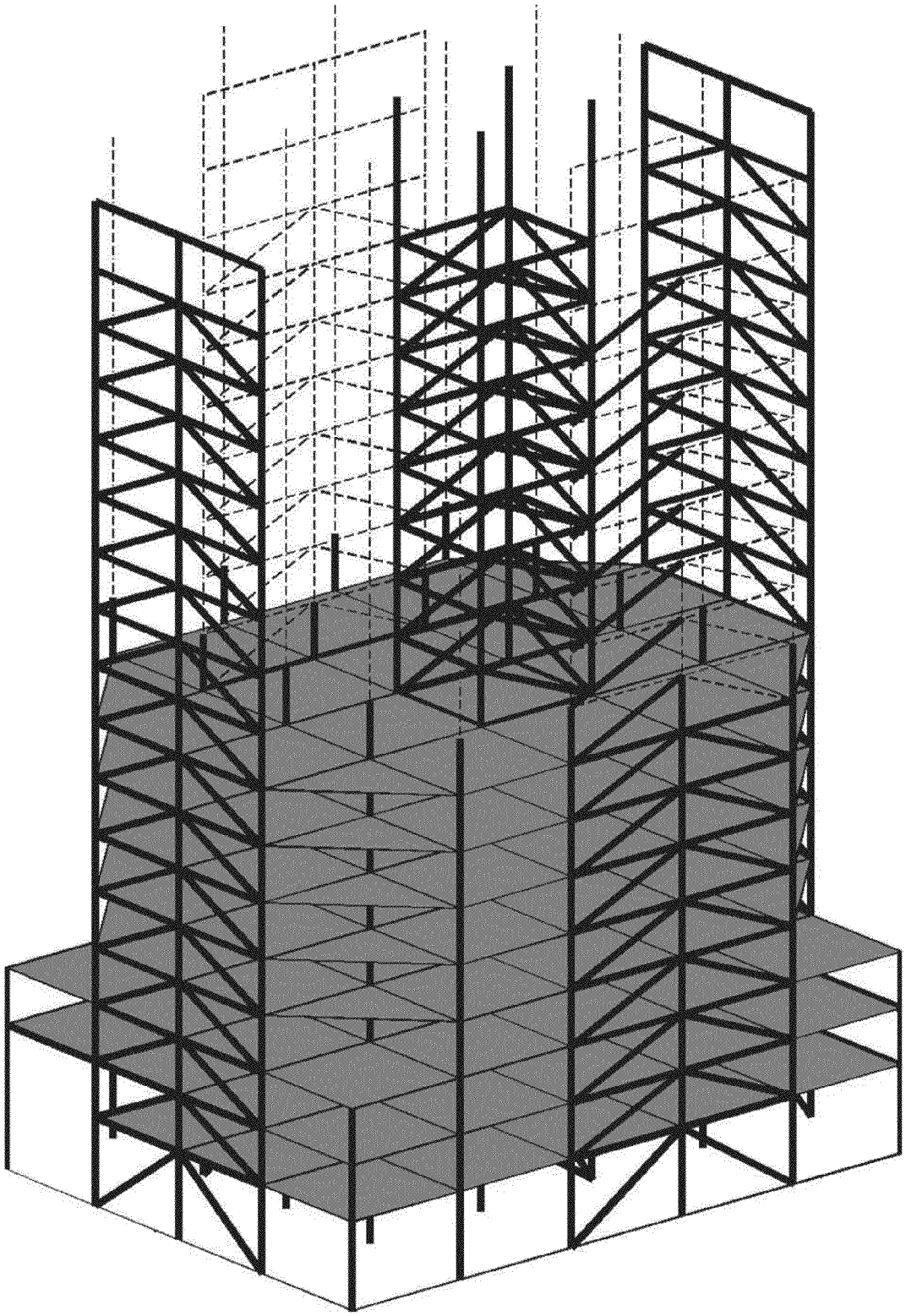

Reference can be made, for example, to FIGS. 4 and 5 which show computer-aided renditions of isometric views of different configurations of plural deployable units (shown in their diagonal deployed condition for ease of explanation) in a multistoried building. In the example embodiment of FIG. 5 braces have been added to the moment frame bays of the building, while in the example embodiment of FIG. 6 braces have been added both to the moment frame bays and to the staircase core of the building. Only lower story units are being shown in the figures for added clarity. Additionally, both figures show the alternating directions discussed at the end of the previous paragraph. Such alternating structure will mean that half of the braces will always be engaged in tension at any instant during earthquake shaking, while the other half of the braces will assume a limp condition, depending on the direction of ground motion during the earthquake. While an embodiment of the present disclosure is directed at deployable units provided in all bays and stories of a building structure, another embodiment is directed at deployable units provides only in a portion of a building structure, e.g. only lower stories of such building structure. The person skilled in the art will understand that location and number of the various deployable units inside a building structure can change on a case-by-case basis in order to achieve a comparable level of stiffness and strength to a standard/permanent brace frame system.

The tension-only nature of the braces makes the deployable units and system ductile. During an earthquake, the braces can act as seismic fuses. Even if they are damaged during an earthquake, replacing these would be rapid especially if they are light-weight, increasing the resiliency of the built environment. In case the deployable units are located outside the building, repairs can be easily made from outside the building, meaning that the building can perhaps be occupied and functional while such repairs are being carried out, significantly minimizing economic losses associated with building closure and business interruption, once again improving the system's resilience.

According to several embodiments of the present disclosure, the deployable system is designed to have tight tolerances to minimize slack. The deployable system frees up the interior of the building and allows for clear views on the exterior. Since several deployable units are installed on a building, the potential for catastrophic structural collapse given the failure of one brace is minimal. Additionally, since in the embodiments of FIGS. 4 and 5 the system is located on the perimeter of the building, and literally wraps the building like a blanket, the torsional stiffness and strength of the structure is maximized, averting a serious, potentially catastrophic, mode of failure.

The foldable brace shown in the embodiments of FIGS. 1-3 has been shown as comprising a plurality of components capable of relative movement with respect to each other, e.g. through hinged connections. Other configurations are also possible such as a telescopic configuration or more generally, a configuration where the shape of the brace in the undeployed condition is different from the shape of the brace in the deployed condition, such as a cable.

A possible triggering signal for the deployable unit of the present disclosure can be an early earthquake warning signal, as already discussed above. Such signal is usually issued by a meteorological agency, geological survey or academic institution through the use of seismometers just after an earthquake is detected. As shown in FIG. 6, a control system (610) can be coupled to a hydraulic jack (620) and output a release signal (630) sending a command to trip the electrical circuit and release pressure of the jack upon interpretation of early earthquake warning signal, which release signal will activate the deployable unit (640) in accordance with the manner described above.

However, the person skilled in the art will understand, upon reading of the present disclosure, that several other triggering mechanisms and/or signals (605), automatic or manual (the latter in case of, e.g., adverse wind conditions), different from or in addition to the early earthquake warning signal can be employed. By way of example and not of limitation, deployment of the unit (640) can be controlled (610) by a sensor/accelerometer (e.g. incorporated into the control system (610)) monitoring the movement of the building above a set threshold, or a power sensor (also in this case possibly incorporated into the control system (610)) sensing presence of power to the building where the deployable unit is mounted, so that the unit is also deployed each time power to the building (or part of the building) is shut off This last embodiment is useful in cases a possible early start of an earthquake disconnects power to the building, independently of the presence of an early earthquake warning signal or not.

The deployable unit shown in the present disclosure can either be built together with the building in which it will be located or at a later stage, as a retrofit measure. In such case, before installation, foundation forces and forces related to columns, beams and connections should be checked and these components boosted or upgraded, if required.

In such latter case, the unit can be made available to the users as a kit of parts comprising a brace, a latching arrangement, a control system, a suspension-and-release system (e.g. a hydraulic jack) and mechanical elements adapted to suitably couple all such parts to a building structure, in order to reach a configuration like the one shown in FIG. 1.

While embodiments of the present disclosure are directed at using the shown units and systems as a prevention against earthquakes, other uses can be provided, such as prevention against storms and/or adverse wind conditions, by keeping the various deployable units deployed for the duration of the adverse event.

The invention claimed is:

1. A deployable unit configured to assume a retracted condition and a deployed condition, comprising:

a retractable brace having a retracted condition and a deployed condition, wherein transition from the retracted condition to the deployed condition occurs through gravity driven movement of the brace;

a latching arrangement, the latching arrangement contacting the brace and keeping the brace in position when the brace is in the deployed condition;

a guiding arrangement to guide the gravity driven movement of the brace, and a control circuit coupled to the retractable brace, the control circuit configured to receive an early earthquake warning (EEW) signal and to output a release command, the release command triggering the gravity driven movement of the brace from the retracted condition to the deployed condition.

2. The deployable unit of claim 1, further comprising:

a wire connected with the brace and configured to hold the brace in place when the brace is in the retracted condition and to assist the gravity driven movement of the brace during the transition from the retracted condition to the deployed condition of the brace, the wire having a wrapped condition when the brace is in the retracted condition and an elongated condition when the brace is in the deployed condition.

3. The deployable unit of claim 2, wherein the brace comprises an engagement rod and wherein the wire is connected with the brace through connection of the wire with the engagement rod, and wherein the latching arrangement is triggered through contact of the latching arrangement with the engagement rod.

4. The deployable unit of claim 2, further comprising a sensor incorporated into the control circuit, the sensor controlling the transition of the brace from the retracted condition to the deployed condition by unwrapping the wire.

5. The deployable unit of claim 2, wherein the wire is a metal string.

6. The deployable unit of claim 1, wherein the brace is a foldable brace and comprises a plurality of components, capable of relative movement with respect to each other, said relative movement occurring during the transition from the retracted condition to the deployed condition of the brace.

7. The deployable unit of claim 6, wherein the foldable brace acts only in tension when in the deployed condition.

8. The deployable unit of claim 6, wherein the foldable brace comprises a plurality of components connected by hinges, the hinges being provided with oversized holes to allow folding of the foldable brace in the deployed condition.

9. The deployable unit of claim 1, wherein the latching arrangement is a rotatable latching arrangement, configured to rotate upon contact of the latching arrangement with the brace during the transition of the brace from the retracted condition to the deployed condition wherein, upon rotation of the latching arrangement, the latching arrangement keeps the brace in position.

10. The deployable unit of claim 9, wherein the brace comprises an engagement rod and wherein the contact of the latching arrangement with the brace occurs through contact of the latching arrangement with the engagement rod.

11. The deployable unit of claim 1, being a light-weight deployable unit wherein the brace is made of steel.

12. The deployable unit of claim 11, wherein the brace is a foldable brace.

13. The deployable unit of claim 1, the deployable unit being located in a quadrangular space defined by a first column, a second column, an upper beam and a lower beam, wherein the brace is located proximate to the upper beam while in the retracted condition, and travels from the upper beam to the lower beam during the transition from the retracted condition to the deployed condition, wherein the brace in the deployed condition diagonally extends from the upper beam to the lower beam between the first column and the second column.

14. A deployable system comprising a plurality of deployable units according to claim 13, each deployable unit being located in a respective quadrangular space.

15. The deployable system of claim 14, wherein the plurality of deployable units comprise horizontally adjacent deployable units with respective braces configured to have opposite diagonal extensions with respect to each other when in the deployed condition.

16. The deployable system of claim 14, wherein the plurality of deployable units are two horizontally adjacent deployable units, with respective braces configured to have opposite diagonal extensions with respect to each other when in the deployed condition.

17. The deployable unit of claim 1, wherein the EEW signal is emitted by a seismometer after an early sign of an earthquake is detected.

18. The deployable unit of claim 17, wherein the EEW signal is received from a meteorological agency, a geological survey or an academic institution using the seismometer.

19. A kit of parts comprising:

a brace configured to assume, in operation, a retracted condition and a deployed condition where the brace is deployed, wherein transition from the retracted condition to the deployed condition occurs through gravity driven movement of the brace;

a latching arrangement configured to contact, in operation, the brace and keeping the brace in position when the brace is in the deployed condition;

a wire, configured to be connected, in operation, with the brace and hold the brace in place when the brace is in the retracted condition and assist the gravity driven movement of the brace during the transition from the retracted condition to the deployed condition of the brace, the wire having a wrapped condition when the brace is in the retracted condition and an elongated condition when the brace is in the deployed condition; and a control system configured to control, in operation, movement of the brace from the retracted condition to the deployed condition and vice versa, the control system comprising a control circuit configured to be coupled, in operation, to the brace, the control circuit configured to receive an early earthquake warning (EEW) signal and to output a release command, the release command triggering the gravity driven movement of the brace from the retracted condition to the deployed condition.

20. The kit of parts of claim 19, further comprising:

a guide rod configured to guide, in operation, the gravity driven movement of the brace;

a pulley on which the wire is to be wound; and a hydraulic jack configured to drive the pulley in operation.

* * * * *